US007934955B1

(12) United States Patent
Hsia

(10) Patent No.: US 7,934,955 B1
(45) Date of Patent: May 3, 2011

(54) CONNECTOR FOR A CABLE

(76) Inventor: Yvonne C. Hsia, Taichung (TW)

( * ) Notice: Subject to any disclaimer, the term of this patent is extended or adjusted under 35 U.S.C. 154(b) by 0 days.

(21) Appl. No.: 12/849,842

(22) Filed: Aug. 4, 2010

(51) Int. Cl.
*H01R 9/05* (2006.01)

(52) U.S. Cl. ..... 439/578

(58) Field of Classification Search ..... 439/578–580, 439/584, 585, 587, 271
See application file for complete search history.

(56) References Cited

U.S. PATENT DOCUMENTS 2,180,923 A * 11/1939 Del Camp ..... 439/578
* cited by examiner

*Primary Examiner* — Javaid Nasri

(57) ABSTRACT

A connector for a cable contains at least one connecting sleeve, an internal tube, a front fitting member, a rear fitting member, a sheath member, and a circular paw piece, wherein the front fitting member, the rear fitting member, and the sheath member are made of plastic material, so that the connector is assembled easily and conveniently without using an auxiliary tool, and can lower production cost and time.

5 Claims, 4 Drawing Sheets

CONNECTOR FOR A CABLE

BACKGROUND OF THE INVENTION

1. Field of the Invention

The present invention relates to a connector for a cable that is assembled easily and conveniently.

2. Description of the Prior Art

Cable is used to transmit image or electronic signal/data, and includes a joint disposed on a connecting end thereof to be fixed to an entry of an electronic device.

Conventional joint for the cable is comprised of a plurality of separated connecting components, and the connecting components are made of metal material. Therefore, the components of the joint can not be assembled easily because of high metal hardness, and they have to be assembled together by using an auxiliary tool. Besides, the components are made of metal material to enhance production cost.

The present invention has arisen to mitigate and/or obviate the afore-described disadvantages.

SUMMARY OF THE INVENTION

The primary object of the present invention is to provide a connector for a cable that is assembled easily and conveniently without using an auxiliary tool.

Another object of the present invention is to provide a connector for a cable that is made of plastic material to lower production cost and time.

To obtain the above objectives, a connector for a cable provided by the present invention comprises a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape, and including an arresting ring extending outward around a front end thereof to abut against the shoulder of the connecting sleeve, and including a circular groove arranged around an outer wall thereof;

a front fitting member being a hollow housing, and including an orifice formed on a rear end thereof, and including a hole disposed on a front end surface thereof, the hole including a circular projection formed around an inner surface thereof to correspond to the circular groove of the internal tube such that the front fitting member is fitted to the outer wall of the internal tube by using the hole and further enable to rotate the connecting sleeve, the front fitting member also including a coupling portion disposed on a rear end thereof;

a rear fitting member formed in a loop shape and including two ends, each with a second opening, including a fixing portion disposed on a front end thereof to connect with the coupling portion of the front fitting member, and the rear fitting member including a stepped protrusion extending from a middle section of an inner surface thereof;

a sheath member formed in a tube shape and including two ends, each having a third opening, to be inserted into the rear fitting member, including a circular retaining slot formed on an outer surface thereof to correspond to the stepped protrusion of the rear fitting member;

a circular paw piece being a circularly metal ratchet paw and including a plurality of paws arranged thereon to be fixed between the front fitting member and the rear fitting member, and the paw being a resilient metal element and tilting toward a center of the circular paw piece.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
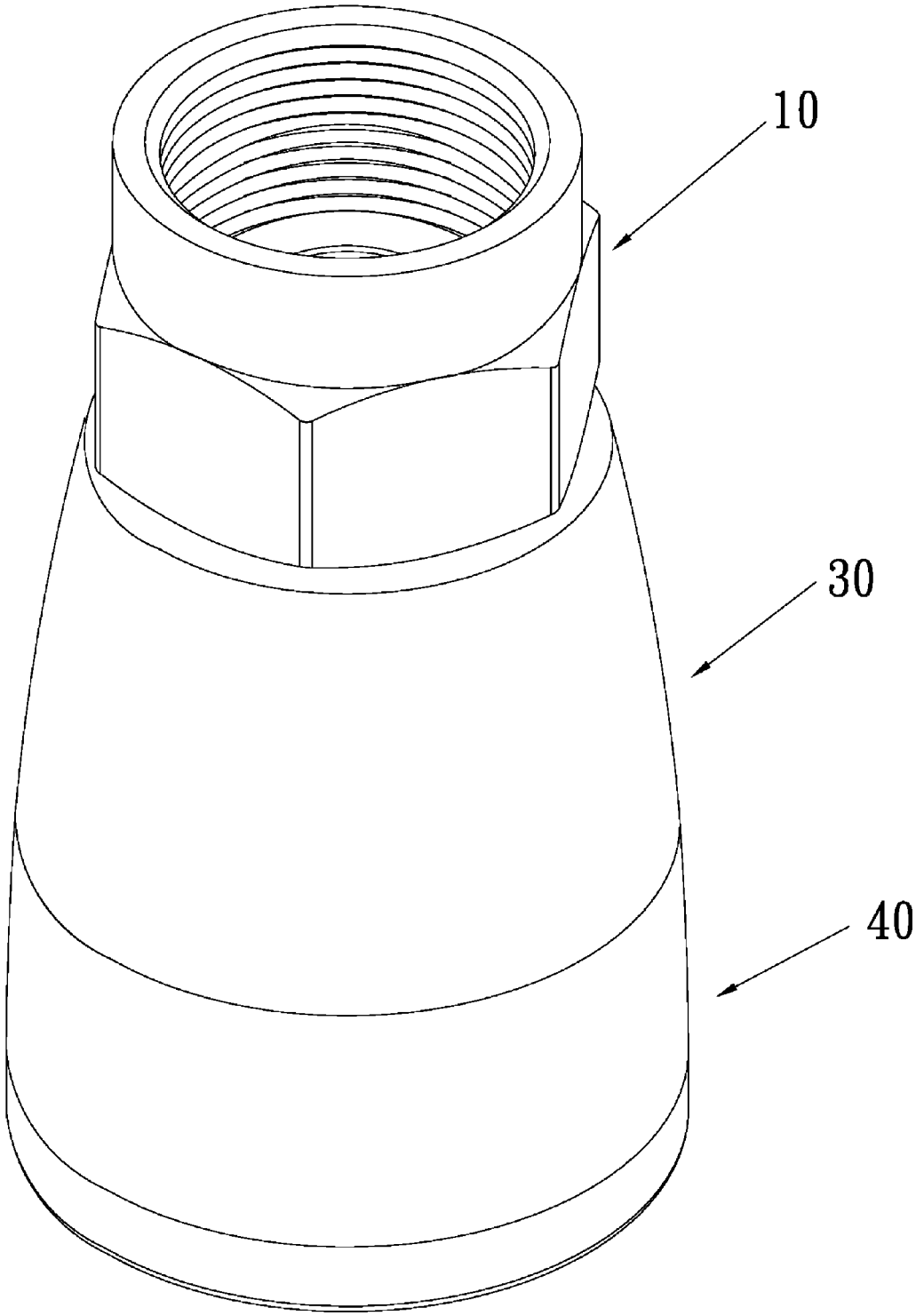
FIG. 1 is a perspective view showing the assembly of a connector for a cable according to a preferred embodiment of the present invention.
Figure 2:
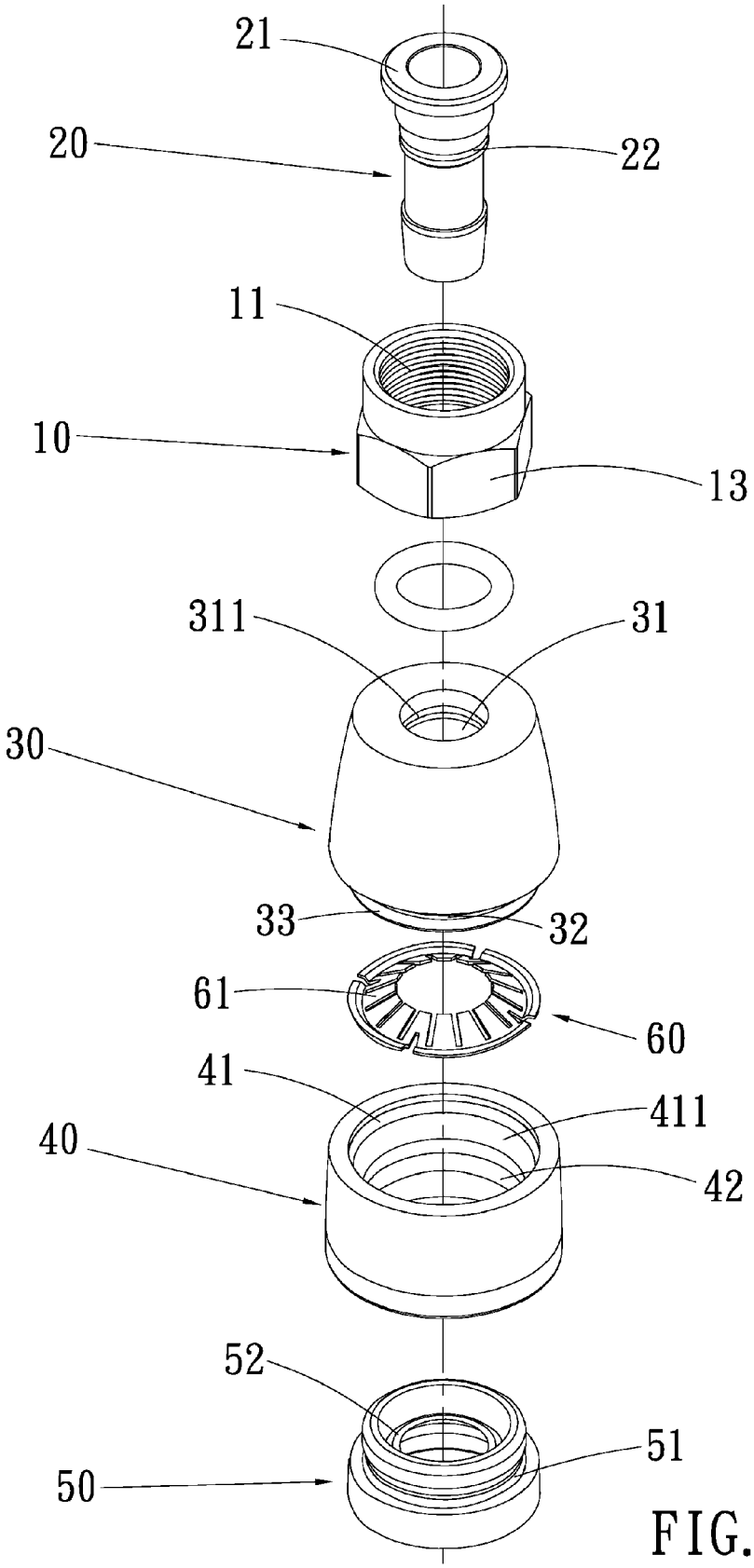
FIG. 2 is a perspective view showing the exploded components of the connector for the cable according to the preferred embodiment of the present invention.
Figure 3:
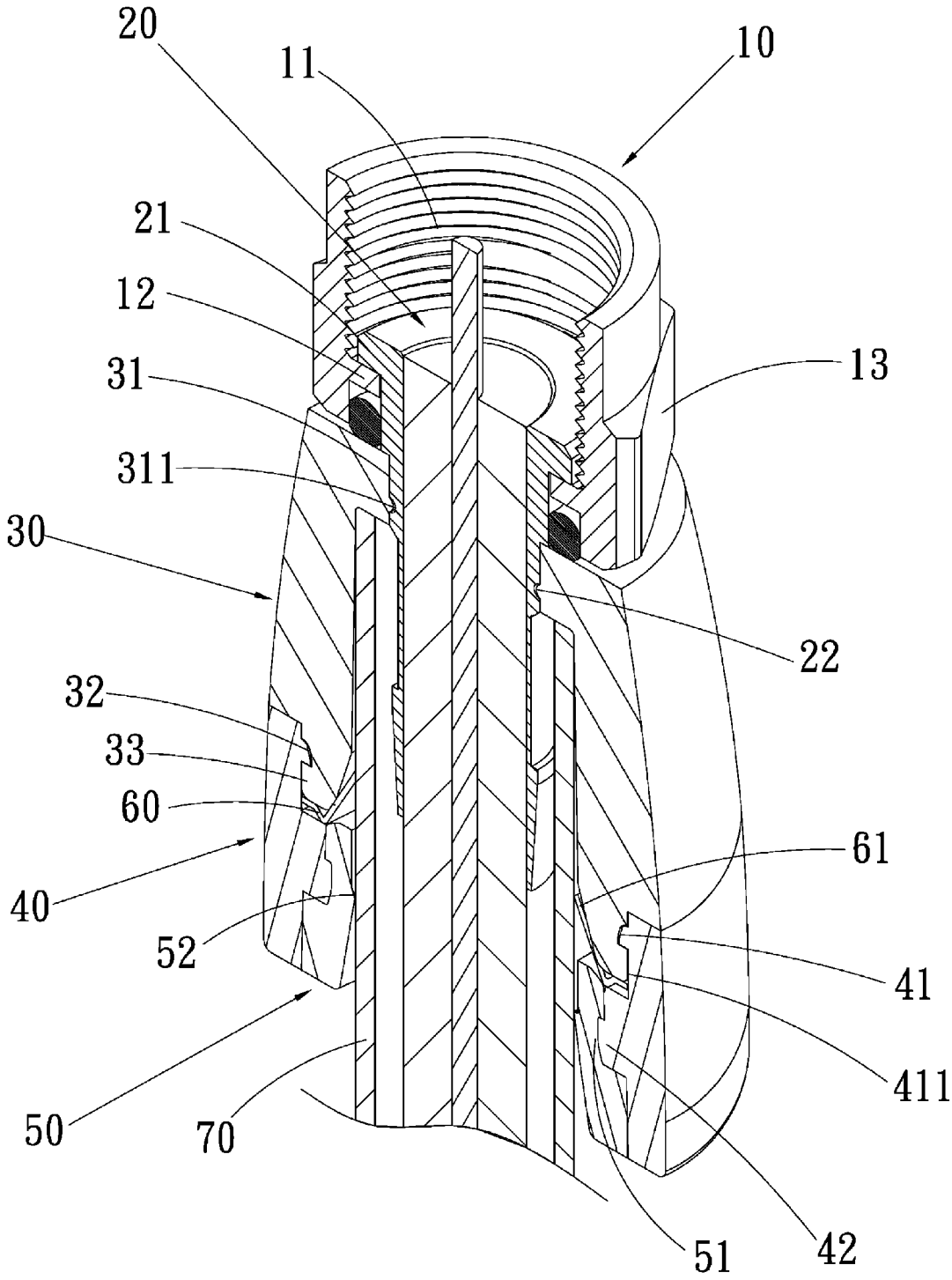
FIG. 3 is a perspective view showing the cross section of the connector for the cable according to the preferred embodiment of the present invention.
Figure 4:
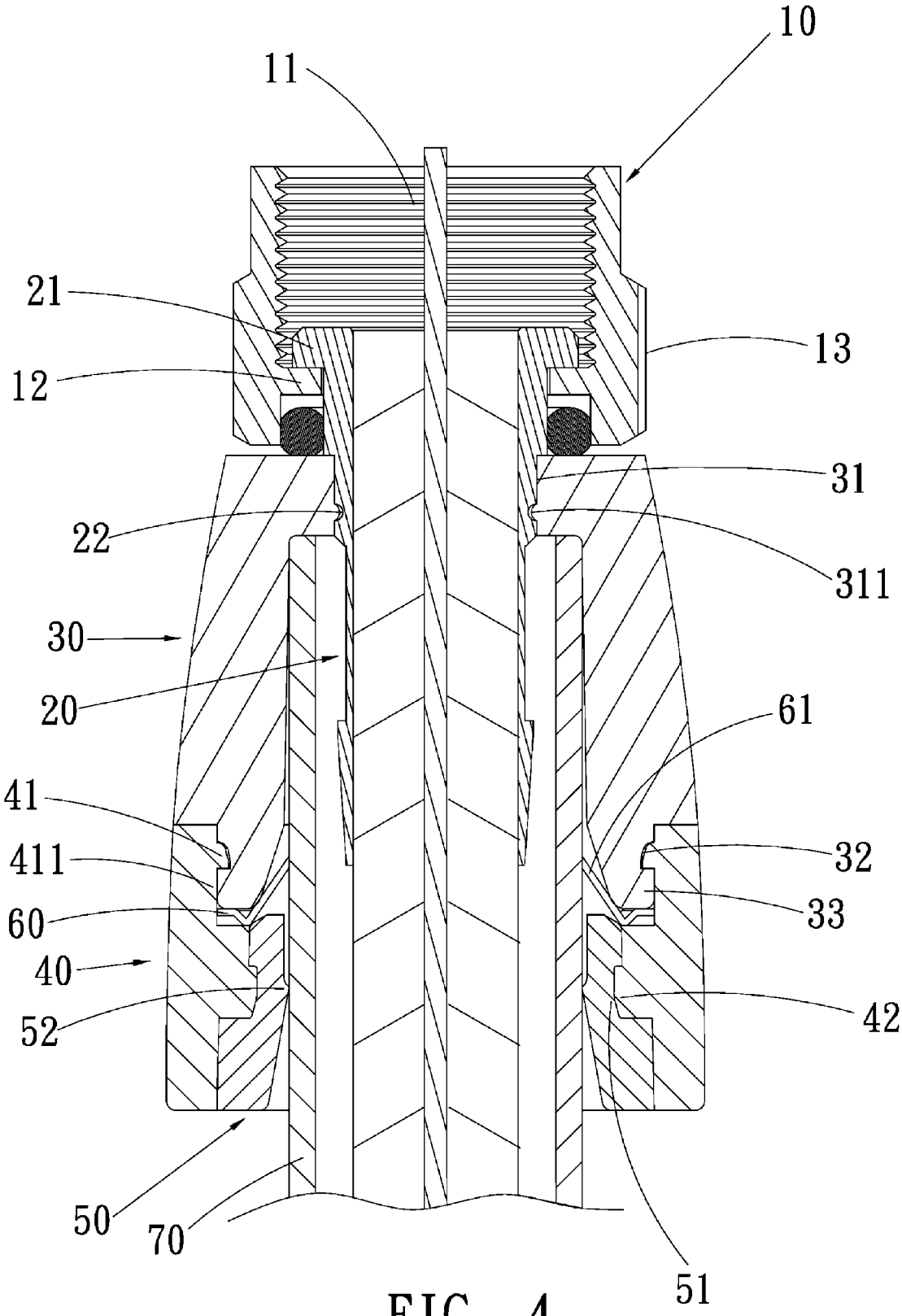
FIG. 4 is a side cross sectional view showing the assembly of the connector for the cable according to the preferred embodiment of the present invention.

Referring to FIGS. 1-4, a connector for a cable in accordance with a preferred embodiment of the present invention includes a connecting sleeve 10, an internal tube 20, a front fitting member 30, a rear fitting member 40, a sheath member 50, and a circular paw piece 60, wherein the front fitting member 30, the rear fitting member 40, and the sheath member 50 are made of plastic material.

The connecting sleeve 10 is formed in an annular tube shape, and includes threads 11 formed around an inner wall of a first opening of an upper end thereof to be screwed to the connector of an electronic device, and includes a shoulder 12 extending around a bottom end of an inner wall thereof, and includes a locking section 13 mounted on an outer wall thereof and formed in a hexagon shape to correspond to an allen wrench.

The internal tube 20 is fitted to the connecting sleeve 10 and formed in a hollowly elongated tube shape to insert a core segment of the cable, and includes an arresting ring 21 extending outward around a front end thereof to abut against the shoulder 12 of the connecting sleeve 10 so as to prevent the connecting sleeve 10 from sliding out of the internal tube 20, and includes a circular groove 22 arranged around an outer wall thereof.

The front fitting member 30 is a hollow housing, and includes an orifice formed on a rear end thereof, and includes a hole 31 disposed on a front end surface thereof, the hole 31 includes a circular projection 311 formed around an inner surface thereof to correspond to the circular groove 22 of the internal tube 20 such that the front fitting member 30 is fitted to the outer wall of the internal tube 20 by using the hole 31 and further enable to rotate the connecting sleeve 10. The front fitting member 30 includes a coupling portion 32 disposed on the rear end thereof and becoming concave from an outer surface thereof, and the coupling portion 32 includes a tab 33 formed on an end surface thereof.

The rear fitting member 40 is formed in a loop shape and includes two ends, each with a second opening, includes a fixing portion 41 disposed on a front end thereof and being a raised block extending outward from an inner surface of the rear fitting member 40 to connect with the coupling portion 32 of the front fitting member 30, and the fixing portion 41 includes an annular recess 411 to correspond to the tab 33 of the front fitting member 30, and the rear fitting member 40 includes a stepped protrusion 42 extending from a middle section of an inner surface thereof.

The sheath member 50 is formed in a tube shape and includes two ends, each with a third opening, to be inserted into the rear fitting member 40, includes a circular retaining slot 51 formed on an outer surface thereof to correspond to the stepped protrusion 42 of the rear fitting member 40, and the sheath member 50 includes a waterproof member 52 extending from an inner surface thereof and becoming tilted toward a central portion thereof slightly.

The circular paw piece 60 is a circularly metal ratchet paw and includes a plurality of paws 61 arranged thereon to be fixed between the front fitting member 30 and the rear fitting member 40 and placed in the annular recess 411 of the rear fitting member 40 and pressed by the tab 33 of the front fitting member 30, and the paw 61 is a resilient metal element and tilts toward a center of the circular paw piece 60 lightly.

In assembly, a prepared cable 70 is inserted from a rear end of the sheath member 50, and the waterproof member 52 of the sheath member 50 is provided to prevent an end portion of the sheath member 50 from being penetrated by water, and when the cable is further pushed into the internal tube 20, the paws 61 of the circular paw piece 60 contact with a jacket of the cable 70 to generate an engaging resistance to prevent from being removed backward, and the core segment of the cable is inserted through the internal tube 20 to extend out of a frond side of the connecting sleeve 10, thereby connecting the connector of the electronic device easily.

While we have shown and described various embodiments in accordance with the present invention, it is clear to those skilled in the art that further embodiments may be made without departing from the scope of the present invention.

What is claimed is:

1. A connector for a cable comprising a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape, and including an arresting ring extending outward around a front end thereof to abut against the shoulder of the connecting sleeve, and including a circular groove arranged around an outer wall thereof;

a front fitting member being a hollow housing, and including an orifice formed on a rear end thereof, and including a hole disposed on a front end surface thereof, the hole including a circular projection formed around an inner surface thereof to correspond to the circular groove of the internal tube such that the front fitting member is fitted to the outer wall of the internal tube by using the hole and further enable to rotate the connecting sleeve, the front fitting member also including a coupling portion disposed on a rear end thereof;

a rear fitting member formed in a loop shape and including two ends, each with a second opening, including a fixing portion disposed on a front end thereof to connect with the coupling portion of the front fitting member, and the rear fitting member including a stepped protrusion extending from a middle section of an inner surface thereof;

a sheath member formed in a tube shape and including two ends, each with a third opening, to be inserted into the rear fitting member, including a circular retaining slot formed on an outer surface thereof to correspond to the stepped protrusion of the rear fitting member;

a circular paw piece being a circularly metal ratchet paw and including a plurality of paws arranged thereon to be fixed between the front fitting member and the rear fitting member, and the paw being a resilient metal element and tilting toward a center of the circular paw piece.

2. The connector for the cable as claimed in claim 1, wherein the front fitting member, the rear fitting member, and the sheath member are made of plastic material.

3. The connector for the cable as claimed in claim 2, wherein the sheath member includes a waterproof member extending from an inner surface thereof and becoming tilted toward a central portion thereof.

4. The connector for the cable as claimed in claim 3, wherein the connecting sleeve includes a locking section mounted on an outer wall thereof.

5. The connector for the cable as claimed in claim 4, wherein the coupling portion becoming concave from an outer surface of the front fitting member, and the fixing portion is a raised block extending outward from an inner surface of the rear fitting member to connect with the coupling portion of the front fitting member.

* * * * *